US011642002B1

(12) United States Patent
Tanpure et al.

(10) Patent No.: US 11,642,002 B1
(45) Date of Patent: May 9, 2023

(54) DISHWASHER AND ADJUSTABLE TINE ASSEMBLY

(71) Applicant: WHIRLPOOL CORPORATION, Benton Harbor, MI (US)

(72) Inventors: Prasad Nivrutti Tanpure, Maharashtra (IN); Ajinkya Anish Bhat, Maharashtra (IN)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 17/719,764

(22) Filed: Apr. 13, 2022

(51) Int. Cl.
*A47L 15/50* (2006.01)

(52) U.S. Cl.
CPC ..... *A47L 15/503* (2013.01)

(58) Field of Classification Search
CPC ..... A47L 15/50; A47L 15/503; A47L 15/505; A47L 19/04
USPC ..... 211/41.3–41.9
See application file for complete search history.

(56) References Cited

U.S. PATENT DOCUMENTS 1,562,614 A * 11/1925 Blakeslee ..... A47L 15/50 211/41.8
1,971,523 A * 8/1934 Feingold ..... A47L 19/04 211/41.5
2,519,711 A * 8/1950 Sprechmann ..... A47F 7/0064 D7/602
3,752,322 A * 8/1973 Fiocca ..... A47L 15/505 211/41.8
4,046,261 A * 9/1977 Yake ..... A47L 15/505 211/184
4,606,464 A * 8/1986 Jordan ..... A47L 15/503 211/184
4,917,248 A * 4/1990 Friskney ..... A47L 15/503 211/184
5,205,419 A * 4/1993 Purtilo ..... A47L 15/505 211/151
5,344,029 A * 9/1994 Oghia ..... A47L 15/505 211/198
5,351,837 A * 10/1994 Smith ..... A47L 15/503 312/311
5,480,035 A * 1/1996 Smith ..... A47L 15/503 211/168
5,601,195 A * 2/1997 Finola ..... A47L 15/507 312/311
6,571,965 B1 * 6/2003 Beck ..... A47L 15/503 211/41.8
6,848,585 B2 * 2/2005 VanLandingham ... A47L 15/503 211/41.9

(Continued)

FOREIGN PATENT DOCUMENTS

DE 102019216603 A1 4/2021
EP 2611352 B1 9/2011

(Continued)

*Primary Examiner* — Patrick D Hawn
(74) *Attorney, Agent, or Firm* — McGarry Bair PC

(57) ABSTRACT

A dish rack assembly includes a dish rack defining an interior. An adjustable tine assembly is located within the interior of the dish rack. The adjustable tine assembly includes first and second sets of tines that are rotatable about a rotational axis. The first set of tines has a first cross member from which multiple first tines extend. The second set of tines has a second cross member from which multiple second tines extend.

20 Claims, 9 Drawing Sheets

(56) References Cited

U.S. PATENT DOCUMENTS 7,231,929 B2 * 6/2007 Landsiedel ..... A47L 15/14 134/201
7,682,465 B2 * 3/2010 Anderson ..... A47L 15/0084 211/41.9
7,766,175 B2 * 8/2010 Jadhav ..... A47L 15/505 211/41.9
7,793,790 B2 * 9/2010 Lee ..... A47L 15/505 211/41.9
7,931,155 B2 * 4/2011 Bastuji ..... A47L 15/503 211/41.9
7,988,107 B2 * 8/2011 Miller ..... A47L 15/505 211/41.9
8,104,628 B2 * 1/2012 Kim ..... A47L 15/503 211/171
8,408,403 B2 * 4/2013 Hedstrom ..... A47L 15/505 211/181.1
8,646,620 B2 * 2/2014 Klump ..... A47L 15/50 211/41.8
8,651,287 B2 * 2/2014 Moser ..... A47L 15/503 211/195
9,949,613 B2 * 4/2018 Blanchard ..... A47L 15/50
9,962,063 B2 * 5/2018 Beshears, Jr. ..... A47L 15/4282
10,638,912 B1 * 5/2020 Visin ..... A47L 15/507
10,888,212 B2 * 1/2021 Feddema ..... A47L 15/50
11,006,813 B2 * 5/2021 Naik ..... A47L 15/50
2006/0254992 A1 * 11/2006 Lim ..... A47L 15/505 211/41.9
2006/0254994 A1 * 11/2006 Lim ..... A47L 15/505 211/41.9
2008/0083678 A1 * 4/2008 Graute ..... A47L 15/505 211/41.8
2012/0056519 A1 * 3/2012 Woo ..... A47L 15/503 312/228.1
2012/0292269 A1 * 11/2012 Klump ..... A47L 15/50 211/41.8
2020/0329947 A1 * 10/2020 Clerkin ..... A47L 15/4278

FOREIGN PATENT DOCUMENTS

EP 2760326 4/2013
KR 20080027732 A 3/2008
KR 20090057710 A 6/2009

* cited by examiner

DISHWASHER AND ADJUSTABLE TINE ASSEMBLY

BACKGROUND

Contemporary automatic dish treating appliances for use in a typical household include a cabinet with an access opening and a tub that can have an open front and at least partially defines a treating chamber into which items, such as kitchenware, glassware, and the like, can be placed to undergo a treating operation, such as washing. A spraying system with multiple sprayers can be provided for recirculating liquid throughout the tub to remove soils from the dishes. The dishwasher can be further provided with a door assembly, which can be hingedly mounted to the tub or to the cabinet for pivoting movement about a pivot axis between closed and opened positions to selectively close and open the open front and the access opening.

At least one rack or basket for supporting soiled dishes can be provided within the tub. The at least one rack or basket can be provided in the form of upper and lower dish racks. A silverware or utensil basket for holding utensils, silverware, cutlery, and the like, may also be provided and is generally removably mounted to the door assembly or within one of the dish racks. The dish racks can further include a plurality of tines or sets of tines that can be provided in a variety of configurations within the dish racks for supporting soiled dishes. Some of the tines within the dish racks may be fixed in position and not movable, while other tines or sets of tines within the dish racks may be movable between at least first and second positions such that the sets of tines are adjustable by a user.

BRIEF DESCRIPTION

An aspect of the present disclosure relates to a dish rack assembly comprising a dish rack defining an interior, and an adjustable tine assembly located within the interior and comprising first and second sets of tines, which are coaxial about a common rotational axis, and rotatable about the rotational axis, the first set of tines having a first cross member from which multiple first tines extend, and the second set of tines having a second cross member from which multiple second tines extend, the second cross member having a C-shaped cross section defining a hollow interior, which receives the first cross member.

Another aspect of the present disclosure relates to an adjustable tine assembly for use within an interior of a dish rack of a dish treating appliance, the adjustable tine assembly located within the interior and comprising first and second sets of tines, which are coaxial about a common rotational axis, and rotatable about the rotational axis, the first set of tines having a first cross member from which multiple first tines extend, and the second set of tines having a second cross member from which multiple second tines extend, the second cross member having a C-shaped cross section defining a hollow interior, which receives the first cross member.

DETAILED DESCRIPTION

In order to provide more flexibility to users, tines or rows of tines can be included with at least one of the dish racks to provide support for various items loaded into the dish treating appliance. The angle or rotational position of at least some of the tines relative to the dish rack can be adjustable to allow a user the flexibility to select the desired tine angle or rotational position to accommodate the particular items to be washed during a particular cycle of the dish treating appliance. Typically, such tine angle or rotational position adjustment methods include separate sets of adjustable tines being provided on separate cross members that can be positioned next to or spaced from one another for independent adjustment. Such arrangement of multiple side-by-side cross members may take up additional space within the dish rack, as well as requiring separate fastening or retaining structures for each adjustable set of tines. The inclusion of such separate cross members and additional retaining structures can take up space within the dish rack and interfere with the placement of and support for the dish items to be washed.

Aspects of the present disclosure relate to an adjustable tine assembly having first and second sets of tines, including cross members, for use with a dish rack of the dish treating appliance. The first and second sets of tines are rotatable about a rotational axis such that the first and second sets of tines can be adjustable between at least upright and non-upright rotational positions. The adjustable tine assembly can be suitable for any manner of applications including that of the household dish treating appliance of FIG. 1, which is illustrated by way of example and not limitation.

Figure 1:
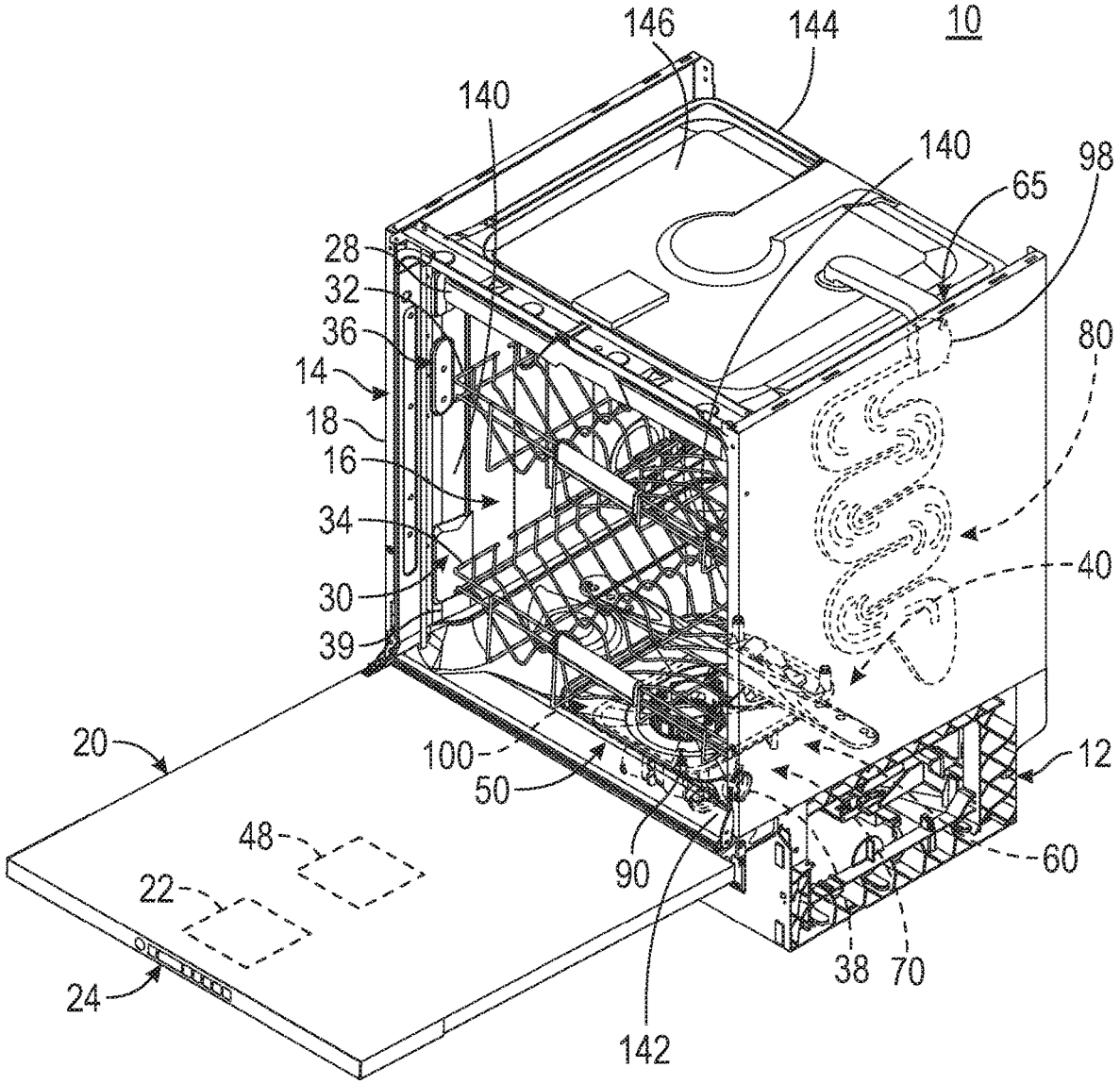
FIG. 1 is a top, front, and right-side perspective view of an automatic dish treating appliance having multiple systems for implementing an automatic cycle of operation.

FIG. 1 illustrates an automatic dish treating appliance 10, illustrated herein as a dishwasher 10, capable of implementing an automatic cycle of operation to treat dishes. As used in this description, the term "dish(es)" is intended to be generic to any item, single or plural, that can be treated in the dishwasher 10, including, without limitation, dishes, plates, pots, bowls, pans, glassware, silverware, and other utensils. As illustrated, the dishwasher 10 is a built-in dishwasher 10 implementation, which is designed for mounting under a countertop or other work surface. However, this description is applicable to other dishwasher implementations such as a stand-alone, multi-tub-type, drawer-type, or a sink-type, for example, as well as dishwashers having varying widths, sizes, and capacities. The dishwasher 10 shares many features of a conventional automatic dishwasher, which may not be described in detail herein except as necessary for a complete understanding of aspects of the disclosure.

The dishwasher 10 has a variety of systems, some of which are controllable, to implement the automatic cycle of operation. A chassis or cabinet is provided to support the variety of systems needed to implement the automatic cycle of operation and can define an interior. As illustrated, for a built-in implementation, the chassis or cabinet includes a frame in the form of a base 12 on which is supported an open-faced tub 14, which at least partially defines a treating chamber 16, having an access opening, illustrated herein as an open face 18, for receiving the dishes. The open-faced tub 14 can have at least a pair of opposing side walls 140 that are spaced apart from one another, such as by being spaced apart by a bottom wall 142, a rear wall 144, and/or a top wall 146. The pair of opposing side walls 140, the bottom wall 142, the rear wall 144, and the top wall 146 can further be thought of as at least partially defining the treating chamber 16, and optionally also the open face 18 to serve as the access opening.

A closure in the form of a door assembly 20 can be hingedly or pivotally mounted to the base 12, or to any other suitable portion of the cabinet or chassis or of the tub 14, for movement relative to the tub 14 between opened and closed positions to selectively open and close the open face 18 of the tub 14. In one example, the door assembly 20 is mounted for pivoting movement about a pivot axis relative to the base 12, the tub 14, or the open face 18. In the opened position, a user can access the treating chamber 16, as shown in FIG. 1, while, in the closed position (not shown), the door assembly 20 covers or closes the open face 18 of the treating chamber 16. Thus, the door assembly 20 provides selective accessibility to the treating chamber 16 for the loading and unloading of dishes or other items.

The chassis or cabinet, as in the case of the built-in dishwasher implementation, can be formed by other parts of the dishwasher 10, like the tub 14 and the door assembly 20, in addition to a dedicated frame structure, like the base 12, with them all collectively forming a uni-body frame by which the variety of systems are supported. In other implementations, like the drawer-type dishwasher, the chassis can be a tub that is slidable relative to a frame, with the closure being a part of the chassis or the countertop of the surrounding cabinetry. In a sink-type implementation, the sink forms the tub and the cover closing the open top of the sink forms the closure. Sink-type implementations are more commonly found in recreational vehicles.

The systems supported by the chassis, while essentially limitless, can include a dish holding system 30, spray system 40, recirculation system 50, drain system 60, water supply system 70, air supply system 65, heating system 90, and filter system 100. These systems are used to implement one or more treating cycles of operation for the dishes, for which there are many, one of which includes a traditional automatic wash cycle.

A basic traditional automatic cycle of operation for the dishwasher 10 has a wash phase, where a detergent/water mixture is recirculated and then drained, which is then followed by a rinse phase where water alone or with a rinse agent is recirculated and then drained. An optional drying phase can follow the rinse phase. More commonly, the automatic wash cycle has multiple wash phases and multiple rinse phases. The multiple wash phases can include a pre-wash phase where water, with or without detergent, is sprayed or recirculated on the dishes, and can include a dwell or soaking phase. There can be more than one pre-wash phases. A wash phase, where water with detergent is recirculated on the dishes, follows the pre-wash phases. There can be more than one wash phase; the number of which can be sensor controlled based on the amount of sensed soils in the wash liquid. One or more rinse phases will follow the wash phase(s), and, in some cases, come between wash phases. The number of wash phases can also be sensor controlled based on the amount of sensed soils in the rinse liquid. The amounts of water, treating chemistry, and/or rinse aid used during each of the multiple wash or rinse steps can be varied. The wash phases and rinse phases can include the heating of the water, even to the point of one or more of the phases being hot enough for long enough to sanitize the dishes. A drying phase can follow the rinse phase(s). The drying phase can include a drip dry, a non-heated drying step (so-called "air only"), heated dry, condensing dry, air dry or any combination. These multiple phases or steps can also be performed by the dishwasher 10 in any desired combination.

A controller 22 can also be included in the dishwasher 10 and operably couples with and controls the various components of the dishwasher 10 to implement the cycles of operation. The controller 22 can be located within the door assembly 20 as illustrated, or it can alternatively be located somewhere within the chassis. The controller 22 can also be operably coupled with a control panel or user interface 24 for receiving user-selected inputs and communicating information to the user. The user interface 24 can provide an input and output function for the controller 22. While the user interface 24 is illustrated in FIG. 1 as being provided on a top surface of the door assembly 20, it will be understood that the user interface 24 can be provided at any suitable location on the door assembly 20, such as on a front surface of the door assembly 20.

The user interface 24 can include operational controls such as one or more knobs, dials, lights, switches, displays, touch screens and the like for communicating with the user, such as enabling a user to input commands, such as a cycle of operation, to the controller 22 and to receive information, for example about the selected cycle of operation. For example, the displays can include any suitable communication technology including that of a liquid crystal display (LCD), a light-emitting diode (LED) array, or any suitable display that can convey a message to the user. The user can enter different types of information including, without limitation, cycle selection and cycle parameters, such as cycle options. Other communications paths and methods can also be included in the dishwasher 10 and can allow the controller 22 to communicate with the user in a variety of ways. For example, the controller 22 can be configured to send a text message to the user, send an electronic mail to the user, or provide audio information to the user either through the dishwasher 10 or utilizing another device such as a mobile phone.

The controller 22 can include the machine controller and any additional controllers provided for controlling any of the components of the dishwasher 10. For example, the controller 22 can include the machine controller and a motor controller. Many known types of controllers can be used for the controller 22. It is contemplated that the controller is a microprocessor-based controller that implements control software and sends/receives one or more electrical signals to/from each of the various working components to effect the control software. As an example, proportional control (P), proportional integral control (PI), and proportional derivative control (PD), or a combination thereof, a proportional integral derivative control (PID control), can be used to control the various components.

The dish holding system 30 can include any suitable structure or structures for receiving or holding dishes within the treating chamber 16. Exemplary dish holders are illustrated in the form of an upper dish rack 32 and lower dish rack 34, commonly referred to as "racks", which are located within the treating chamber 16. The upper dish rack 32 and the lower dish rack 34 each define an interior and are typically mounted for slidable movement in and out of the treating chamber 16 through the open face 18 for ease of loading and unloading. In one example, it is common for the upper dish rack 32 to be slidably mounted within and to the tub 14 by the use of a suitable drawer withdrawal assembly, such as by the use of drawer guides, slides, or rails 36, while the lower dish rack 34 is instead typically provided with wheels or rollers 38 that can roll along a travel path 39 defined by at least a portion of the dishwasher 10. For example, it is typical for the lower dish rack 34 to be slidable along the travel path 39 such that the lower dish rack 34 can roll along the travel path 39 and then continue to roll onto the door assembly 20, when the door assembly 20 is in the opened position and allows for withdrawal of the dish racks 32, 34.

By way of further example, in such a case, it is also typical that the travel path 39 can include a type of rails 39, but that rails 39 for the lower dish rack 34 may differ in structure from the rails 36 for the upper dish rack 32, and in particular such that the rails 39 may be provided simply as a ledge or a surface formed by the tub 14, such as formed or carried by the side walls 140 or the bottom wall 142 of the tub 14. By providing the rails 39 for the lower dish rack 34 as a simpler support surface, such as a ledge, rather than a more restrictive or enclosing structure such as the rails 36, the rails 39 are better able to accommodate movement or instability of the lower dish rack 34 as the lower dish rack 34 rolls onto the door assembly 20, going from the static, stable tub 14 to the movable door assembly 20. In this way, the rails 39 allow more tolerance for movement as the lower dish rack 34 rolls along the door assembly 20.

In addition, dedicated dish holders can also be provided. One such dedicated dish holder is a third level rack 28 located above the upper dish rack 32. Like the upper dish rack 32, the third level rack 28 is slidably mounted to the tub 14 with drawer guides/slides/rails 36. The third level rack 28 is typically used to hold utensils, such as tableware, spoons, knives, spatulas, etc., in an on-the-side or flat orientation. However, the third level rack 28 is not limited to holding utensils. If an item can fit in the third level rack 28, it can be washed in the third level rack 28. The third level rack 28 generally has a much shorter height or lower profile than the upper and lower dish racks 32, 34. Typically, the height of the third level rack 28 is short enough that a typical glass cannot be stood vertically in the third level rack 28 and the third level rack 28 still be slid into the treating chamber 16.

Another dedicated dish holder can be a utensil or silverware basket (not shown), which is typically located in the treating chamber 16 and carried by one of the upper or lower dish racks 32, 34 or mounted to the door assembly 20. The silverware basket typically holds utensils and the like in an upright orientation as compared to the on-the-side or flat orientation of the third level rack 28. More than one silverware basket can be provided with the dishwasher 10.

A dispenser assembly 48 is provided to store and dispense treating chemistry, e.g. detergent, anti-spotting agent, etc., into the treating chamber 16. The dispenser assembly 48 can be mounted on an inner surface of the door assembly 20, as shown, or can be located at other positions within the chassis or treating chamber 16, such that the dispenser assembly 48 is positioned to be accessed by the user for refilling of the dispenser assembly 48, whether it is necessary to refill the dispenser assembly 48 before each cycle (i.e. for a single use dispenser) or only periodically (i.e. for a bulk dispenser). The dispenser assembly 48 can dispense one or more types of treating chemistries. The dispenser assembly 48 can be a single-use dispenser, which holds a single dose of treating chemistry, or a bulk dispenser, which holds a bulk supply of treating chemistry and which is adapted to dispense a dose of treating chemistry from the bulk supply during the cycle of operation, or a combination of both a single use and bulk dispenser. The dispenser assembly 48 can further be configured to hold multiple different treating chemistries. For example, the dispenser assembly 48 can have multiple compartments defining different chambers in which treating chemistries can be held.

Figure 2:
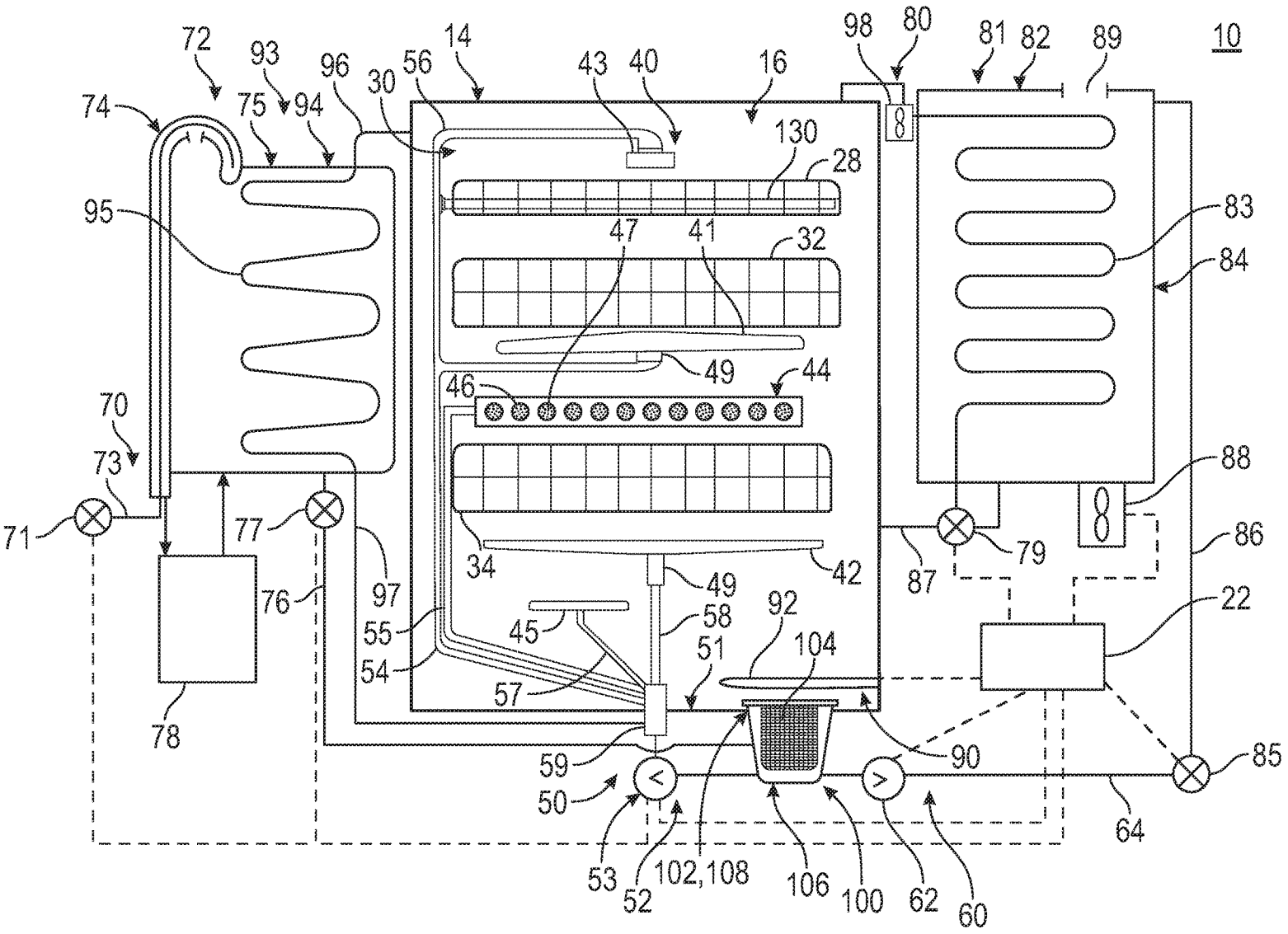
FIG. 2 is a schematic view of the dish treating appliance of FIG. 1 and illustrating at least some of the plumbing and electrical connections between at least some of systems.

Turning to FIG. 2, the spray system 40 is provided for spraying liquid in the treating chamber 16 and can have multiple spray assemblies or sprayers 41, 42, 43, 44, 45, 130, some of which can be dedicated to a particular one of the dish holders, to particular area of a dish holder, to a particular type of cleaning, or to a particular level of cleaning, etc. The sprayers 41, 42, 43, 44, 45, 130 can be fixed or movable, such as rotating, relative to the treating chamber 16 or dish holder. Exemplary sprayers 41, 42, 43, 44, 45, 130 are illustrated and include an upper spray arm 41, a lower spray arm 42, a third level sprayer 43, a deep-clean sprayer 44, and a spot sprayer 45. The upper spray arm 41 and lower spray arm 42 can be rotating spray arms, located below the upper dish rack 32 and lower dish rack 34, respectively, and rotate about a generally centrally located and vertical axis. In one non-limiting example, at least one drive assembly, illustrated herein as at least one motor 49, is operably coupled to one of or to each of the upper spray arm 41 and the lower spray arm 42 in order to control and drive rotation of the lower spray arm 42. The third level sprayer 43 is located above the third level rack 28. The third level sprayer 43 is illustrated as being fixed, but could move, such as in rotating. In addition to the third level sprayer 43 or in place of the third level sprayer 43, a sprayer 130 can be located at least in part below a portion of the third level rack 28, though it will be understood that such a sprayer 130 can be provided adjacent any of the racks 28, 32, 34. The sprayer 130 is illustrated as a fixed tube, carried by the third level rack 28, but could move, such as in rotating about a longitudinal axis.

The deep-clean sprayer 44 is a manifold extending along a rear wall of the tub 14 and has multiple nozzles 46, with multiple apertures 47, generating an intensified and/or higher pressure spray than the upper spray arm 41, the lower spray arm 42, or the third level sprayer 43. The nozzles 46 can be fixed or can move, such as by way of rotating. The spray emitted by the deep-clean sprayer 44 defines a deep clean zone, which, as illustrated, would extend along a rear side of the lower dish rack 34. Thus, dishes needing deep cleaning, such as dishes with baked-on food, can be positioned in the lower dish rack 34 to face the deep-clean sprayer 44. The deep-clean sprayer 44, while illustrated as only one unit on a rear wall of the tub 14, could comprise multiple units and/or extend along multiple portions, including different walls, of the tub 14, and can be provided above, below, or beside any of the dish holders 28, 32, 34 wherein deep cleaning is desired.

The spot sprayer 45, like the deep-clean sprayer 44, can emit an intensified and/or higher pressure spray, especially to a discrete location within one of the dish holders 28, 32, 34. While the spot sprayer 45 is shown below the lower dish rack 34, it could be adjacent any part of any dish holder 28, 32, 34 or along any wall of the tub 14 where special cleaning is desired. In the illustrated location below the lower dish rack 34, the spot sprayer 45 can be used independently of or in combination with the lower spray arm 42. The spot sprayer 45 can be fixed or can move, such as in rotating.

These sprayers 41, 42, 43, 44, 45, 130 are illustrative examples of suitable sprayers and are not meant to be limiting as to the type of suitable sprayers 41, 42, 43, 44, 45, 130. Additionally, it will be understood that not all of the exemplary sprayers 41, 42, 43, 44, 45, 130 need be included within the dishwasher 10, and that less than all of the sprayers 41, 42, 43, 44, 45, 130 described can be included in a suitable dishwasher 10.

The recirculation system 50 recirculates the liquid sprayed into the treating chamber 16 by the sprayers 41, 42, 43, 44, 45, 130 of the spray system 40 back to the sprayers 41, 42, 43, 44, 45, 130 to form a recirculation loop or circuit by which liquid can be repeatedly and/or continuously sprayed onto dishes in the dish holders 28, 32, 34. The recirculation system 50 can include a sump 51 and a pump assembly 52. The sump 51 collects the liquid sprayed in the treating chamber 16 and can be formed by a sloped or recess portion of the bottom wall 142 of the tub 14. The pump assembly 52 can include one or more pumps such as recirculation pump 53. The sump 51 can also be a separate module that is affixed to the bottom wall and include the pump assembly 52.

Multiple supply conduits 54, 55, 56, 57, 58 fluidly couple the sprayers 41, 42, 43, 44, 45, 130 to the recirculation pump 53. A recirculation valve 59 can selectively fluidly couple each of the conduits 54, 55, 56, 57, 58 to the recirculation pump 53. While each sprayer 41, 42, 43, 44, 45, 130 is illustrated as having a corresponding dedicated supply conduit 54, 55, 56, 57, 58, one or more subsets, comprising multiple sprayers from the total group of sprayers 41, 42, 43, 44, 45, 130, can be supplied by the same conduit, negating the need for a dedicated conduit 54, 55, 56, 57, 58 for each sprayer 41, 42, 43, 44, 45, 130. For example, a single conduit can supply the upper spray arm 41 and the third level sprayer 43. Another example is that the sprayer 130 is supplied liquid by the conduit 56, which also supplies the third level sprayer 43.

The recirculation valve 59, while illustrated as a single valve, can be implemented with multiple valves. Additionally, one or more of the conduits 54, 55, 56, 57, 58 can be directly coupled to the recirculation pump 53, while one or more of the other conduits 54, 55, 56, 57, 58 can be selectively coupled to the recirculation pump 53 with one or more valves. There are essentially an unlimited number of plumbing schemes to connect the recirculation system 50 to the spray system 40. The illustrated plumbing is not limiting.

The drain system 60 drains liquid from the treating chamber 16. The drain system 60 includes a drain pump 62 fluidly coupling the treating chamber 16 to a drain line 64. As illustrated, the drain pump 62 fluidly couples the sump 51 to the drain line 64.

While separate recirculation 53 and drain pumps 62 are illustrated, a single pump can be used to perform both the recirculating and the draining functions, such as by configuring the single pump to rotate in opposite directions, or by providing a suitable valve system. Alternatively, the drain pump 62 can be used to recirculate liquid in combination with the recirculation pump 53. When both a recirculation pump 53 and drain pump 62 are used, the drain pump 62 is typically more robust than the recirculation pump 53 as the drain pump 62 tends to have to remove solids and soils from the sump 51, unlike the recirculation pump 53, which tends to recirculate liquid which has solids and soils filtered away to at least some extent.

A water supply system 70 is provided for supplying fresh water to the dishwasher 10 from a water supply source, such as a household water supply via a household water valve 71. The water supply system 70 includes a water supply unit 72 having a water supply conduit 73 with a siphon break 74 or an air break 74. While the water supply conduit 73 can be directly fluidly coupled to the tub 14 or any other portion of the dishwasher 10, the water supply conduit 73 is shown fluidly coupled to a supply tank 75, which can store the supplied water prior to use. The supply tank 75 is fluidly coupled to the sump 51 by a supply line 76, which can include a controllable valve 77 to control when water is released from the supply tank 75 to the sump 51.

The supply tank 75 can be conveniently sized to store a predetermined volume of water, such as a volume required for a phase of the cycle of operation, which is commonly referred to as a "charge" of water. The storing of the water in the supply tank 75 prior to use is beneficial in that the water in the supply tank 75 can be "treated" in some manner, such as softening or heating prior to use.

A water softener 78 can be provided with the water supply system 70 to soften the fresh water. The water softener 78 is shown fluidly coupling the water supply conduit 73 to the supply tank 75 so that the supplied water automatically passes through the water softener 78 on the way to the supply tank 75. However, the water softener 78 could directly supply the water to any other part of the dishwasher 10 than the supply tank 75, including directly supplying the tub 14. Alternatively, the water softener 78 can be fluidly coupled downstream of the supply tank 75, such as in-line with the supply line 76. Wherever the water softener 78 is fluidly coupled, it can be done so with controllable valves, such that the use of the water softener 78 is controllable and not mandatory.

An air supply system 65 is provided to aid in the treating of the dishes during the cycle of operation by supplying air to at least a portion of the dishwasher 10, a non-limiting example of which includes the treating chamber 16. The air supply system 65 can include a variety of assemblies, pathways, and circuits for supplying air to different portions of the dishwasher 10 and for different purposes within the dishwasher 10, such that the air supply system 65 can be thought of as comprising all of the air supplying or air circulating portions of the dishwasher 10. In one non-limiting example, the air supply system 65 comprises a drying system 80 that is provided to aid in the drying of the dishes during the drying phase. The drying system 80 as illustrated, by way of non-limiting example, includes a condensing assembly 81 having a condenser 82 formed of a serpentine conduit 83 with an inlet fluidly coupled to an upper portion of the tub 14 and an outlet fluidly coupled to a lower portion of the tub 14, whereby moisture laden air within the tub 14 is drawn from the upper portion of the tub 14, passed through the serpentine conduit 83, where liquid condenses out of the moisture laden air and is returned to the treating chamber 16 where it ultimately evaporates or is drained via the drain pump 62. The serpentine conduit 83 can be operated in an open loop configuration, where the air is exhausted to atmosphere, a closed loop configuration, where the air is returned to the treating chamber 16, or a combination of both by operating in one configuration and then the other configuration. A fan or blower 98 can be fluidly coupled with the serpentine conduit 83 to move air through the serpentine conduit 83. It will also be understood that the serpentine conduit 83 is not limited to having a serpentine shape and can instead be provided with any suitable size and shape.

To enhance the rate of condensation, the temperature difference between the exterior of the serpentine conduit 83 and the moisture laden air can be increased by cooling the exterior of the serpentine conduit 83 or the surrounding air. To accomplish this, an optional cooling tank 84 is added to the condensing assembly 81, with the serpentine conduit 83 being located within the cooling tank 84. The cooling tank 84 is fluidly coupled to at least one of the spray system 40, recirculation system 50, drain system 60, or water supply system 70, such that liquid can be supplied to the cooling tank 84. The liquid provided to the cooling tank 84 from any of the systems 40, 50, 60, 70 can be selected by source and/or by phase of cycle of operation such that the liquid is at a lower temperature than the moisture laden air or even lower than the ambient air.

As illustrated, the liquid is supplied to the cooling tank 84 by the drain system 60. A valve 85 fluidly connects the drain line 64 to a supply conduit 86 fluidly coupled to the cooling tank 84. A return conduit 87 fluidly connects the cooling tank 84 back to the treating chamber 16 via a return valve 79. In this way a fluid circuit is formed by the drain pump 62, drain line 64, valve 85, supply conduit 86, cooling tank 84, return valve 79 and return conduit 87 through which liquid can be supplied from the treating chamber 16, to the cooling tank 84, and back to the treating chamber 16. Alternatively, the supply conduit 86 could fluidly couple to the drain line 64 if re-use of the water is not desired.

To supply cold water from the household water supply via the household water valve 71 to the cooling tank 84, the water supply system 70 would first supply cold water to the treating chamber 16, then the drain system 60 would supply the cold water in the treating chamber 16 to the cooling tank 84. It should be noted that the supply tank 75 and cooling tank 84 could be configured such that one tank performs both functions.

The drying system 80 can use ambient air, instead of cold water, to cool the exterior of the serpentine conduit 83. In such a configuration, a blower 88 is connected to the cooling tank 84 and can supply ambient air to the interior of the cooling tank 84. The cooling tank 84 can have a vented top 89 to permit the passing through of the ambient air to allow for a steady flow of ambient air blowing over the serpentine conduit 83.

The cooling air from the blower 88 can be used in lieu of the cold water or in combination with the cold water. The cooling air will be used when the cooling tank 84 is not filled with liquid. Advantageously, the use of cooling air or cooling water, or combination of both, can be selected based on the site-specific environmental conditions. If ambient air is cooler than the cold water temperature, then the ambient air can be used. If the cold water is cooler than the ambient air, then the cold water can be used. Cost-effectiveness can also be taken into account when selecting between cooling air and cooling water. The blower 88 can be used to dry the interior of the cooling tank 84 after the water has been drained. Suitable temperature sensors for the cold water and the ambient air can be provided and send their temperature signals to the controller 22, which can determine which of the two is colder at any time or phase of the cycle of operation.

A heating system 90 is provided for heating water used in the cycle of operation. The heating system 90 includes a heater 92, such as an immersion heater 92, located in the treating chamber 16 at a location where it will be immersed by the water supplied to the treating chamber 16, such as within or near the sump 51. However, it will also be understood that the heater 92 need not be an immersion heater 92; it can also be an in-line heater located in any of the conduits. There can also be more than one heater 92, including both an immersion heater 92 and an in-line heater. The heater 92 can also heat air contained in the treating chamber 16. Alternatively, a separate heating element (not shown) can be provided for heating the air circulated through the treating chamber 16.

The heating system 90 can also include a heating circuit 93, which includes a heat exchanger 94, illustrated as a serpentine conduit 95, located within the supply tank 75, with a supply conduit 96 supplying liquid from the treating chamber 16 to the serpentine conduit 95, and a return conduit 97 fluidly coupled to the treating chamber 16. The heating circuit 93 is fluidly coupled to the recirculation pump 53 either directly or via the recirculation valve 59 such that liquid that is heated as part of a cycle of operation can be recirculated through the heat exchanger 94 to transfer the heat to the charge of fresh water residing in the supply tank 75. As most wash phases use liquid that is heated by the heater 92, this heated liquid can then be recirculated through the heating circuit 93 to transfer the heat to the charge of water in the supply tank 75, which is typically used in the next phase of the cycle of operation.

A filter system 100 is provided to filter un-dissolved solids from the liquid in the treating chamber 16. The filter system 100 includes a coarse filter 102 and a fine filter 104, which can be a removable basket 106 residing the sump 51, with the coarse filter 102 being a screen 108 circumscribing the removable basket 106. Additionally, the recirculation system 50 can include a rotating filter in addition to or in place of the either or both of the coarse filter 102 and fine filter 104. Other filter arrangements are contemplated, such as an ultrafiltration system.

Figure 3:
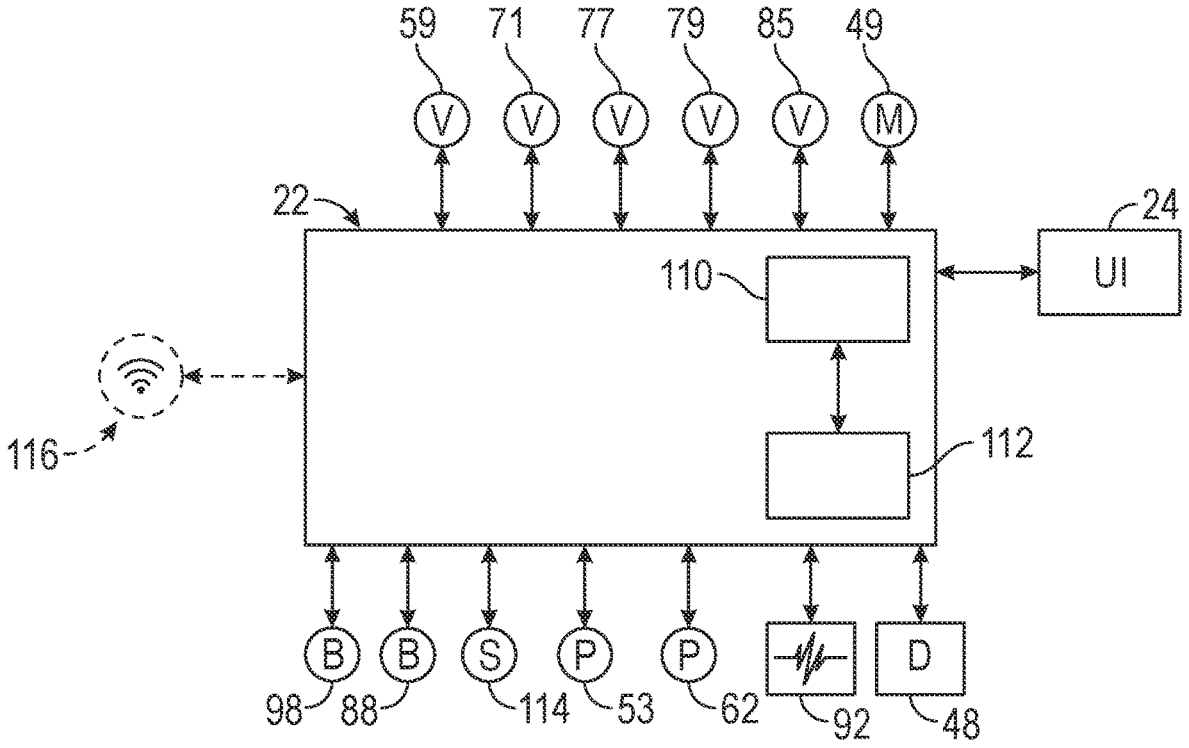
FIG. 3 is a schematic view of a controller of the dish treating appliance of FIGS. 1 and 2.

As illustrated schematically in FIG. 3, the controller 22 can be coupled with the heater 92 for heating the wash liquid during a cycle of operation, the drain pump 62 for draining liquid from the treating chamber 16, the recirculation pump 53 for recirculating the wash liquid during the cycle of operation, the user interface 24 for receiving user selected inputs and communicating information to the user, the dispenser assembly 48 for selectively dispensing treating chemistry to the treating chamber 16, the at least one motor 49 for selectively actuating rotation of the upper spray arm 41 and/or the lower spray arm 42, the blower 98 for providing air through the serpentine conduit 83, and the blower 88 for providing air into the cooling tank 84. The controller 22 can also communicate with the recirculation valve 59, the household water valve 71, the controllable valve 77, the return valve 79, and the valve 85 to selectively control the flow of liquid within the dishwasher 10. Optionally, the controller 22 can include or communicate with a wireless communication device 116.

The controller 22 can be provided with a memory 110 and a central processing unit (CPU) 112. The memory 110 can be used for storing control software that can be executed by the CPU 112 in completing a cycle of operation using the dishwasher 10 and any additional software. For example, the memory 110 can store a set of executable instructions including one or more pre-programmed automatic cycles of operation that can be selected by a user and executed by the dishwasher 10. Examples, without limitation, of cycles of operation include: wash, heavy duty wash, delicate wash, quick wash, pre-wash, refresh, rinse only, timed wash, dry, heavy duty dry, delicate dry, quick dry, or automatic dry, which can be selected at the user interface 24. The memory 110 can also be used to store information, such as a database or table, and to store data received from one or more components of the dishwasher 10 that can be communicably coupled with the controller 22. The database or table can be used to store the various operating parameters for the one or more cycles of operation, including factory default values for the operating parameters and any adjustments to them by the control assembly or by user input.

The controller 22 can also receive input from one or more sensors 114 provided in one or more of the assemblies or systems of the dishwasher 10 to receive input from the sensors 114, which are known in the art and not shown for simplicity. Non-limiting examples of sensors 114 that can be communicably coupled with the controller 22 include, to name a few, an ambient air temperature sensor, a treating chamber temperature sensor, such as a thermistor, a water supply temperature sensor, a door open/close sensor, a moisture sensor, a chemical sensor, and a turbidity sensor to determine the soil load associated with a selected grouping of dishes, such as the dishes associated with a particular area of the treating chamber 16.

Figure 4:
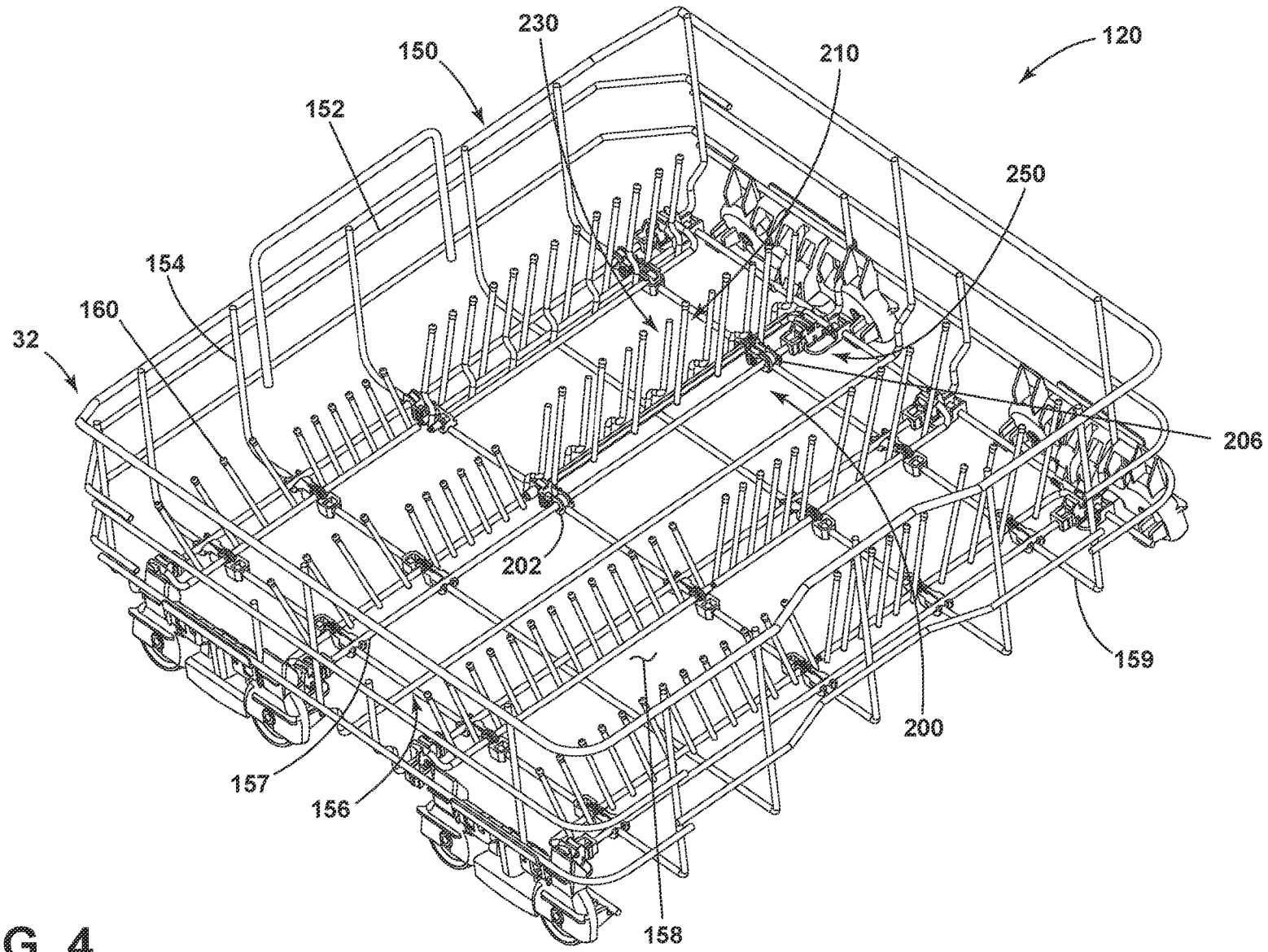
FIG. 4 illustrates a top perspective view of a dish rack assembly with an adjustable tine assembly according to an aspect of the present disclosure and for use with the dish treating appliance of FIGS. 1-3.

Turning now to FIG. 4, a perspective view of a dish rack assembly 120 comprising the upper dish rack 32 is illustrated. It will be understood that the upper dish rack 32 and lower dish rack 34 can be formed in any suitable manner and are not limited to the illustrated shapes and structures. In the illustrated example, a perimeter wall 150, comprising a plurality of cross members 152 and vertical members 154, extending upwardly from a bottom wall, shown as a floor latticework 156, to define an interior 158 of the upper dish rack 32. The floor latticework 156 comprises intersecting first members 157 and second members 159. While the first members 157 are illustrated herein as extending across a width of the upper dish rack 32 and the second members 159 are illustrated herein as extending across a length or depth of the upper dish rack 32, it will be understood that these orientations are not limiting. The floor latticework 156 can further define contoured portions (not shown) of the floor latticework 156 that can extend upwardly or downwardly to aid in positioning the various shapes and sizes of dishes within the upper dish rack 32. Further still, a plurality of positioning tines 160 can extend upwardly from the floor latticework 156 into the interior 158 to aid in positioning of dish items.

The dish rack assembly 120 further comprises at least one adjustable tine assembly 200 located within the interior 158. While only the upper dish rack 32 is illustrated herein as including the adjustable tine assembly 200 and forming a part of the dish rack assembly 120, it will be understood that either or both of the upper dish rack 32 or the lower dish rack 34 can be included as part of the dish rack assembly 120 and can include the at least one adjustable tine assembly 200. Further, it will be understood that the dishwasher 10 can also include a combination of fixed and moveable tines 160 or sets of tines 160, or that all of the tines 160 within the dishwasher 10 can be provided as adjustable tine assemblies 200. Further still, at least one adjustable tine assembly 200 can be provided within the upper dish rack 32 or the lower rack 34, or both.

Figure 5:
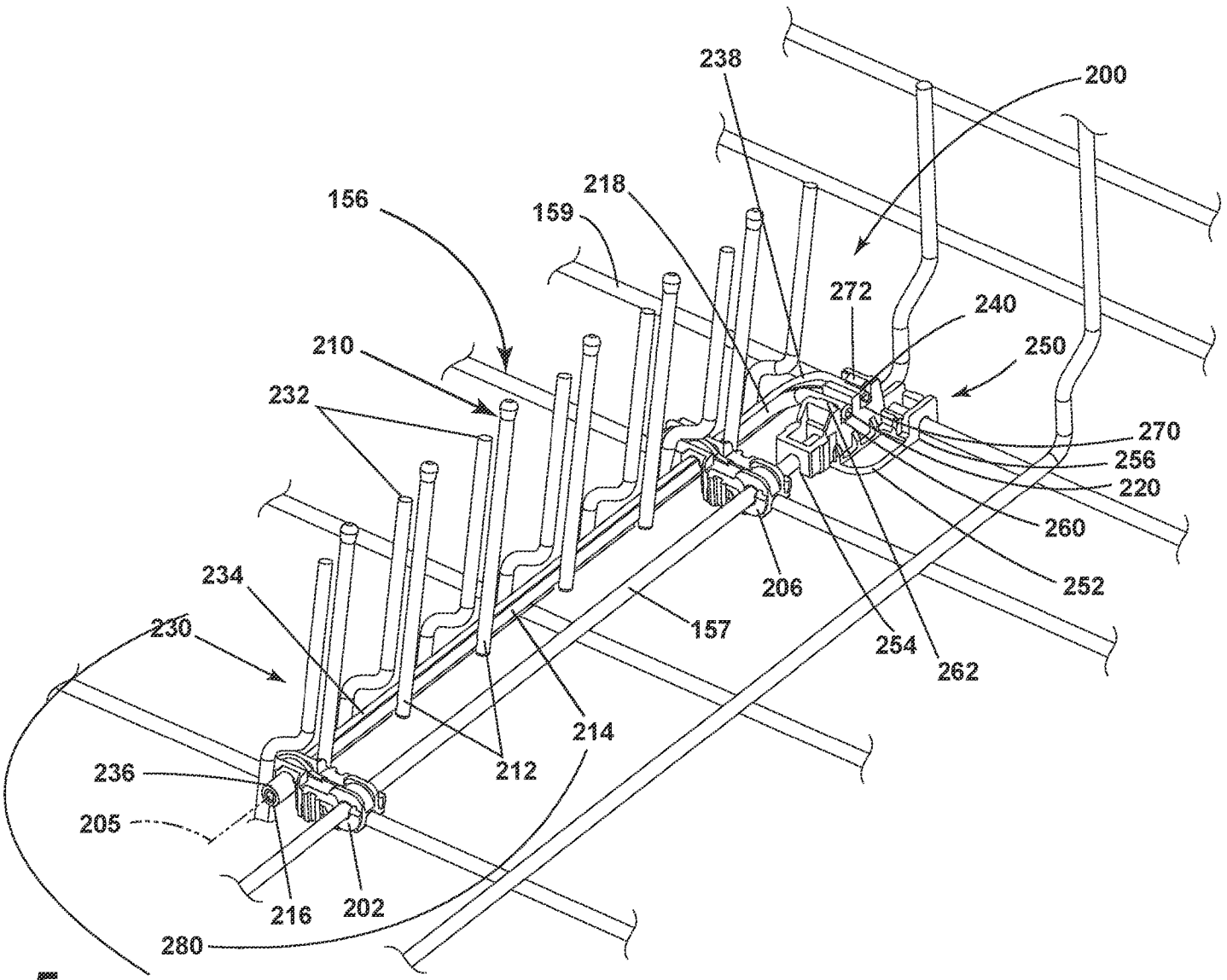
FIG. 5 illustrates an enlarged perspective view of the adjustable tine assembly of FIG. 4 including a first set of tines and a second set of tines, with both the first and second sets of tines in an upright rotational position.

Turning now to the enlarged view of the adjustable tine assembly 200 illustrated in FIG. 5, it can be better seen that the adjustable tine assembly 200 comprises at least a first set of tines 210 and a second set of tines 230 that are rotatably coupled to the upper dish rack 32, such that the adjustable tine assembly 200 can be collectively thought of as being rotatable relative to the upper dish rack 32. That is, where the adjustable tine assembly 200 is provided, the adjustable tine assembly 200 can be coupled to the upper dish rack 32 in such a way that the entire adjustable tine assembly 200 is rotatably or pivotally mounted to the upper dish rack 32. Alternately, at least portions of the adjustable tine assembly 200 can be fixedly coupled to or integrally formed with the upper dish rack 32 such that only the first and second sets of tines 210, 230 themselves are rotatable or pivotable relative to the upper dish rack 32. By way of non-limiting example, the adjustable tine assembly 200 further comprises at least one mounting element, illustrated herein as a first mounting element 202 and a second mounting element 206, coupling the first and second sets of tines 210, 230 to the upper dish rack 32, and specifically to the floor latticework 156. As illustrated herein, the first and second mounting elements 202, 206 are fixedly coupled to the upper dish rack 32 to rotatably mount the first and second sets of tines 210, 230 to the upper dish rack 32, such that the first and second sets of tines 210, 230 are rotatable relative to both the upper dish rack 32 and to the first and second mounting elements 202, 206. It will also be understood that, while the adjustable tine assembly 200 is illustrated herein as including two mounting elements 202, 206, any suitable number of mounting elements 202, 206 can be provided, including only a single mounting element.

As illustrated herein, the first and second sets of tines 210, 230 can be generally co-extensive in length, though it will be understood that such an arrangement is not limiting and that it is also within the scope of the present disclosure that the first and second sets of tines 210, 230 can differ in length. By way of non-limiting example, the adjustable tine assembly 200, and therefore also the first and second sets of tines 210, 230, can extend across only a portion of a dimension of the upper dish rack 32, as illustrated herein, though it is also contemplated that the adjustable tine assembly 200 can extend fully across a dimension of the upper dish rack 32, such as by extending along the entirety of one of a length or a width of the upper dish rack 32. Further by way of non-limiting example, in the case that the adjustable tine assembly 200 extends fully across a dimension of the upper dish rack 32, a single adjustable tine assembly 200 can extend across the full dimension, or the adjustable tine assembly 200 can be split into more than one section across the full dimension, such as being split into a front portion and a back portion adjustable tine assembly 200. Alternatively, in the case that the adjustable tine assembly 200 extends only partially across a dimension of the upper dish rack 32, the adjustable tine assembly 200 can extend across only a portion of a width of the upper dish rack 32, as illustrated, such as by extending across a left side portion or a right side portion of the width of the upper dish rack 32, or by extending across only a portion of a length or depth of the upper dish rack 32, such as by extending across a front portion or a rear portion of the length or depth of the upper dish rack 32.

The adjustable tine assembly 200 further comprises at least one latch assembly 250 having at least a portion that is coupled to the upper dish rack 32, and specifically to the floor latticework 156, and further having at least a portion that is operably coupled with at least one of the first and second sets of tines 210, 230 to provide control of a rotational position of the at least one of the first and second sets of tines 210, 230 relative to the upper dish rack 32, and more specifically to selectively fix a rotational position of the at least one of the first and second sets of tines 210, 230.

While the latch assembly 250 is illustrated herein as being coupled with the floor latticework 156 along the perimeter wall 150 at a side of the upper dish rack 32, it will be understood that other locations for the latch assembly 250 are also contemplated. For example, the latch assembly 250 can be coupled with a front or rear of the upper dish rack 32. In the case that the adjustable tine assembly 200 does not extend all the way between the sides of the upper dish rack 32, but rather covers, for example, a left half or right half of the upper dish rack 32, as illustrated, the latch assembly 250 can be provided in the interior 158 or at a left or right side to control the respective halves or separate portions of the adjustable tine assembly 200. In addition, the adjustable tine assembly 200 can extend from front to rear between the perimeter wall 150 of the upper dish rack 32, rather than between the left and right side. In this case, the latch assembly 250 can be provided at the front or rear. It is also contemplated that more than one latch assembly 250 can be provided to couple with a single adjustable tine assembly 200, such that one latch assembly 250 couples with each end of the adjustable tine assembly 200.

Referring now to the adjustable tine assembly 200 and its components in greater detail, the enlarged view of FIG. 5 further illustrates that the first set of tines 210 comprises at least one first tine 212, illustrated herein as multiple first tines 212, extending from an elongated element having a longitudinal body axis, illustrated herein as a first cross member 214, such that the first cross member 214, and specifically the longitudinal body axis of the first cross member 214, forms a rotational axis 215 (FIG. 6) for the first set of tines 210, and about which the first set of tines 210 is rotatable. The first cross member 214 extends between a first distal end 216 and a second distal end 218, with the first tines 212 spaced along the first cross member 214 between the first and second distal ends 216, 218. In one non-limiting example, the first set of tines 210 is provided as a row or a set of generally vertically oriented, laterally-spaced first tines 212 coupled to one another, such as by the first cross member 214. It is contemplated that the first set of tines 210 can comprise a planar array of parallel positioned first tines 212, or that the first tines 212 can extend from the first cross member 214 in various angles to form alternative angled supports for supporting dishes in various cleaning positions, though it will be understood that the first set of tines 210 can be formed in any suitable shape or manner.

Likewise, the second set of tines 230 comprises at least one second tine 232, illustrated herein as multiple second tines 232, extending from an elongated element having a longitudinal body axis, illustrated herein as a second cross member 234, such that the second cross member 234, and specifically the longitudinal body axis of the second cross member 234, forms a rotational axis 235 (FIG. 6) for the second set of tines 230, and about which the second set of tines 230 is rotatable. The second cross member 234 extends between a first distal end 236 and a second distal end 238, with the second tines 232 spaced along the second cross member 234 between the first and second distal ends 236, 238. In one non-limiting example, the second set of tines 230 is provided as a row or a set of generally vertically oriented, laterally-spaced second tines 232 coupled to one another, such as by the second cross member 234. It is contemplated that the second set of tines 230 can comprise a planar array of parallel positioned second tines 232, or that the second tines 232 can extend from the second cross member 234 in various angles to form alternative angled supports for supporting dishes in various cleaning positions, though it will be understood that the second set of tines 230 can be formed in any suitable shape or manner.

While the first cross member 214 defines the rotational axis 215 for the first set of tines 210 and the second cross member 234 defines the rotational axis 235 for the second set of tines 230, in an assembled condition of the adjustable tine assembly 200, the first cross member 214 is at least partially received within the second cross member 234 such that the first and second cross members 214, 234 are positioned coaxially with respect to one another. Thus, the rotational axes 215, 235 can further be collectively thought of as forming a common rotational axis 205 for the adjustable tine assembly 200, about which the first and second sets of tines 210, 230, and therefore also the first and second cross members 214, 234, are coaxially positioned and about which the first and second sets of tines 210, 230 are rotatable, both relative to the upper dish rack 32 and relative to one another. Further yet, the first cross member 214 and the second cross member 234 can be collectively thought of as forming a common cross member 280 for the adjustable tine assembly 200, rotatable about the common rotational axis 205.

Each of the first and second cross members 214, 234 further comprises a latch for the first and second sets of tines 210, 230, illustrated herein as a finger 220, 240 that extends from the first and second cross members 214, 234, respectively, at the second distal ends 218, 238. More specifically, the fingers 220, 240 extend radially outwardly from the rotational axes 215, 235 of each of the first and second cross members 214, 234, respectively, at their second distal ends 218, 238. By way of non-limiting example, and as illustrated herein, the first and second cross members 214, 234 can be substantially co-extensive in length. More specifically, it is contemplated that the second cross member 234 has a length that is at least as long as the length of the first cross member 214, and further that the second cross member 234 has a length that is greater than the length of the first cross member 214. It will be understood that the second cross member 234 can have a length that is greater than the length of the first cross member 214 by any suitable margin, so long as the margin is sufficient for the finger 240 of the second cross member 234 to extend and be spaced beyond the finger 220 of the first cross member 214 to allow rotation of the fingers 220, 240 relative to one another without contact or interference between the fingers 220, 240, as well as to allow the fingers 220, 240 to selectively interact with the latch assembly 250 independently of one another and without contact or interference with the other of the fingers 220, 240.

With the second cross member 234 thus having a greater length than the first cross member 214 such that the finger 240 of the second cross member 234 is spaced beyond the finger 220 of the first cross member 214, and as illustrated herein, the finger 240 of the second cross member 234 is not provided as at least partially receiving or as being positioned coaxially with the finger 220 of the first cross member 214, in order to allow relative rotation between the fingers 220, 240, and thus also between the first and second sets of tines 210, 230. However, it will be understood that the fingers 220, 240 are cross-sectionally shaped the same as the rest of the first and second cross members 214, 234, such that the fingers 220, 240 could be positioned coaxially, with the finger 220 being at least partially received within the finger 240. Thus, it is contemplated that, alternatively or additionally to the finger 240 being spaced beyond the finger 220, the first and second cross members 214, 234 could be at least selectively provided such that the finger 220 could be at least partially received within the finger 240 for simultaneous or co-rotation of the first and second sets of tines 210, 230.

Further by way of non-limiting example, and as illustrated herein, the first and second mounting elements 202, 206 can be spaced apart from one another along the lengths of the first and second cross members 214, 234, which can also be thought of as being spaced apart from one another along the length of the common cross member 280. More specifically, the first mounting element 202 rotatably couples the first and second sets of tines 210, 230 to the upper dish rack 32 by movably retaining the common cross member 280 at a position near the first distal ends 216, 236 of the nested, coaxially positioned first and second cross members 214, 234.

Similarly, the second mounting element 206 couples the first and second sets of tines 210, 230 to the upper dish rack 32 by movably retaining the common cross member 280 at a position near the second distal ends 218, 238 of the nested, coaxially positioned first and second cross members 214, 234. Further, each of the first and second mounting elements 202, 206 couples with, such as by being fixed to, at least one of the members 157, 159 of the floor latticework 156. Further yet, by way of non-limiting example, each of the first and second mounting elements 202, 206 couples with, such as by being fixed to, at least one of the first members 157 and to at least one of the intersecting second members 159 of the floor latticework 156.

Regardless of where the first and second mounting elements 202, 206 are positioned along the first and second cross members 214, 234, it will be understood that the first and second cross members 214, 234 are not fixed to the first and second mounting elements 202, 206, but rather are rotatably retained by the first and second mounting elements 202, 206, such that the first and second cross members 214, 234 are independently rotatable relative to the first and second mounting elements 202, 206, as well as relative to one another and/or rotatable, either independently or simultaneously, relative to the latch assembly 250. More specifically, the first and second mounting elements 202, 206 retain portions of the first and second cross members 214, 234 of the adjustable tine assembly 200 such that the first and second mounting elements 202, 206 allow for rotation of the first and second cross members 214, 234, but otherwise aid in securing the adjustable tine assembly 200 within the interior 158. In this manner, the first and second mounting elements 202, 206 are configured to rotationally retain the first and second cross members 214, 234. However, while the first and second mounting elements 202, 206 are illustrated and described herein as rotationally retaining the first and second cross members 214, 234, such that the first and second mounting elements 202, 206 do not impede or resist rotation of the first and second cross members 214, 234 within the first and second mounting elements 202, 206, it will be understood that the first and second mounting elements 202, 206 could alternatively be configured to provide rotational resistance to at least one of the first and second cross members 214, 234, such that the first and second mounting elements 202, 206 can hold a rotational position of the at least one of the first and second cross members 214, 234 by resistance or frictional engagement therewith.

While the first and second mounting elements 202, 206 permit rotation of the first and second sets of tines 210, 230, the latch assembly 250 is configured to selectively fix the rotational position of at least one of the first and second sets of tines 210, 230. As illustrated, and by way of non-limiting example, the latch assembly 250 can selectively fix the rotational position of both of the first and second sets of tines 210, 230, independently of one another, and can also be utilized to aid in locating the adjustable tine assembly 200 within the interior 158 of the upper dish rack 32. The latch assembly 250 comprises a strike 252 that is coupled to the upper dish rack 32, such as by being fixedly coupled to the upper dish rack 32, and more specifically to engage at least one of the members 157, 159 of the floor latticework 156.

More specifically, in the illustrated non-limited example, the strike 252 has a body defining at least a first mounting portion 254 and a second mounting portion 256, such that the first mounting portion 254 is configured to couple to one of the first members 157 and the second mounting portion 256 is configured to couple to one of the second members 159 of the floor latticework 156 to mount the strike 252 to intersecting members 157, 159 of the upper dish rack 32. By way of non-limiting example, the first and second mounting portions 254, 256 can engage portions of the floor latticework 156 through a friction fit or snap-fit mechanism to secure the strike 252 to the upper dish rack 32. While the strike 252 is illustrated as engaging with more than one wire of the floor latticework 156, it will be understood that this need not be the case. Further, the strike 252, and specifically the first and second mounting portions 254, 256, are generally shown as following the contours of the floor latticework 156 to remain unobtrusive within the interior 158, although this also need not be the case.

It will be understood that the wires of the upper dish rack 32, or the lower dish rack 34, as the case may be, are generally flexible enough that the floor latticework 156 or members 157, 159 can be pushed or pulled when installing the strike 252 and/or the first and second mounting elements 202, 206 of one or more adjustable tine assemblies 200. It is also contemplated that the strike 252 and/or the first and second mounting elements 202, 206 can be easily disengaged from the portions of the upper dish rack 32 to which they are mounted, thereby freeing up the upper dish rack 32 should the user wish to remove the adjustable tine assembly 200. The adjustable tine assembly 200 can sit within the interior 158 and be held in place with the strike 252 and the first and second mounting elements 202, 206, so once the strike 252 and/or the first and second mounting elements 202, 206 are disengaged from the upper dish rack 32, the adjustable tine assembly 200 can be removed.

The latch assembly 250 further comprises the fingers 220, 240 of the first and second cross members 214, 234, which serve as latches for the first and second sets of tines 210, 230. More specifically, the strike 252 further defines at least one detent, illustrated herein as first and second detents 260, 270, that can be provided, by way of non-limiting example, at an upper portion of the strike 252. Each of the first and second detents 260, 270 can be provided with a retaining flange 262, 272 protruding into and above at least a portion of the first and second detents 260, 270. The fingers 220, 240 are configured to selectively engage with the strike 252, and specifically with the first and second detents 260, 270, to selectively fix the rotational position of each of the first and second sets of tines 210, 230. To this end, the strike 252 can be located at the second distal ends 218, 238 of the first and second cross members 214, 234, such that the strike 252 forms a portion of the adjustable tine assembly 200 and operably couples the first and second sets of tines 210, 230 to the upper dish rack 32 at the second distal ends 218, 238 of the first and second cross members 214, 234, specifically when the fingers 220, 240 selectively engage with the first and second detents 260, 270.

By way of the non-limiting example as illustrated, one of the first and second detents 260, 270, illustrated herein as the first detent 260, is configured to selectively receive the finger 220 of the first cross member 214, while the other of the first and second detents 260, 270, illustrated herein as the second detent 270, is configured to selectively receive the finger 240 of the second cross member 234. The retaining flanges 262, 272 are positioned such that the retaining flanges 262, 272 serve to retain the fingers 220, 240 within or at least partially within the first and second detents 260, 270. It is also contemplated that either or both of the retaining flanges 262, 272 can define multiple detents, such as a set of detents arranged in an arc, to permit the first and second sets of tines 210, 230 to be retained in multiple different rotational positions. By way of non-limiting example, the first and second detents 260, 270, and optionally also the retaining flanges 262, 272, can engage portions of the fingers 220, 240 through a friction fit or snap-fit mechanism to selectively retain the fingers 220, 240 within the first and second detents 260, 270, and therefore also to the strike 252. Further by way of non-limiting example, and as illustrated herein, when the fingers 220, 240 of the first and second cross members 214, 234 are selectively received within the first and second detents 260, 270, the first and second sets of tines 210, 230 are selectively fixed in an upright rotational position.

Figure 6:
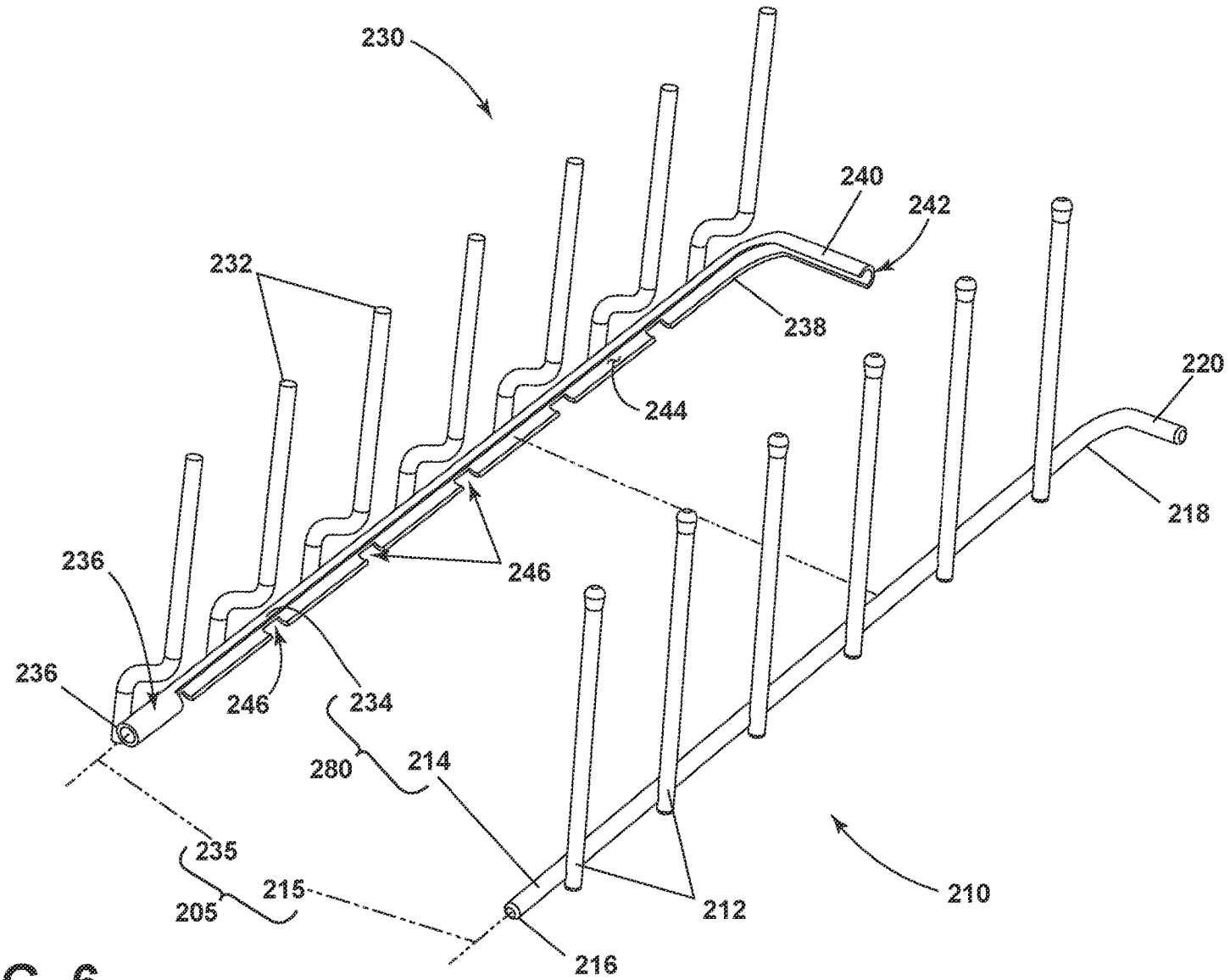
FIG. 6 illustrates an exploded perspective view of the first and second sets of tines of the adjustable tine assembly of FIG. 4.

Turning now to FIG. 6, the details of the first and second cross members 214, 234 can be better seen in the exploded view of the first and second sets of tines 210, 230. In the illustrated example, the first cross member 214 defining the first rotational axis 215 comprises a solid rod defining a circumference, while the second cross member 234 defining the second rotational axis 235 has at least a portion having a C-shaped cross section 242 defining a hollow interior 244 of the second cross member 234, within which the first cross member 214 can be received. However, it will be understood that the first cross member 214 is not limited to being provided as a solid rod, but could alternatively be provided as a hollow rod or as having a C-shaped cross section in the same way as the second cross member 234. When the first cross member 214 is received within the hollow interior 244 of the second cross member 234, the portion of the second cross member 234 having the C-shaped cross section 242 only partially surrounds the circumference of the first cross member 214. It is further contemplated that the at least the portion of the second cross member 234 having the C-shaped cross section 242 is sufficiently resilient such that the portion of the second cross member 234 having the C-shaped cross section 242 can snap over or about the at least half of the circumference of the first cross member 214 when the first cross member 214 is received within the hollow interior 244. Further, when the first cross member 214 is coaxially received within the hollow interior 244, the rotational axes 215, 235 can be thought of as collectively forming the common rotational axis 205 and the first and second cross members 214, 234 can be thought of as collectively forming the common cross member 280.

The portion of the second cross member 234 having the C-shaped cross section 242 can further include a plurality of notches 246 spaced apart along the length of the second cross member 234. In one example, the number and position of the notches 246 corresponds to the number and position of the first tines 212 on the first cross member 214, such that the first tines 212 can be at least partially received within the notches 246 when the first and second cross members 214, 234 are rotated relative to one another. It is contemplated that the portion of the second cross member 234 having the C-shaped cross section 242 is equal to at least half of the total length of the first cross member 214. More specifically, it is contemplated that the portion of the second cross member 234 having the C-shaped cross section 242 and not comprising the notches 246 is equal to at least half of the total length of the first cross member 214.

The second cross member 234 can further include a portion 248 that completely surrounds the circumference of at least a portion of the first cross member 214. By way of non-limiting example, the portion 248 of the second cross member 234 that completely surrounds the circumference of the first cross member 214 is provided at the first distal end 236 of the second cross member 234. Thus, to insert the first cross member 214 into the hollow interior 244, the first distal end 216 of the first cross member 214 is first inserted into the completely surrounding portion 248 of the second cross member 234, then the remainder of the first cross member 214 is moved into the hollow interior 244 until the C-shaped cross section 242 snaps over the first cross member 214.

As illustrated herein, the first tines 212 are provided as straight tines 212, while the second tines 232 are provided as angled tines 232. It will be understood that such structures of the first and second tines 212, 232 are not limiting, and that it is also contemplated that both the first and second tines 212, 232 can be provided as straight tines, that both the first and second tines 212, 232 can be provided as angled tines, that the first tines 212 can be angled tines, while the second tines 232 can be straight tines, or that the first or second tines 212, 232 can comprise a mix of angled and straight tines. Any suitable arrangement of tines 212, 232 is contemplated so as to provide the tines 212, 232 in any suitable plane or pattern to provide support for dish items. Regardless of the structure of the first and second tines 212, 232, as illustrated and by way of non-limiting example, the first and second tines 212, 232 can be coupled to a side of the first and second cross members 214, 234, respectively, so as to be tangentially attached to the first and second cross members 214, 234, respectively, rather than extending, such as radially, from a top of the first and second cross members 214, 234. In this way, the angle of attachment or tangential angle of the tines 212, 232 relative to the first and second cross members 214, 234 can also be optimized or specifically provided to suit desired dish loading configurations. In addition, tines 212, 232 that are welded to the first and second cross members 214, 234 in such an angled position are stronger than tines that are welded onto a rod in a perpendicular position to extend radially, rather than tangentially from the rod.

Figure 7:
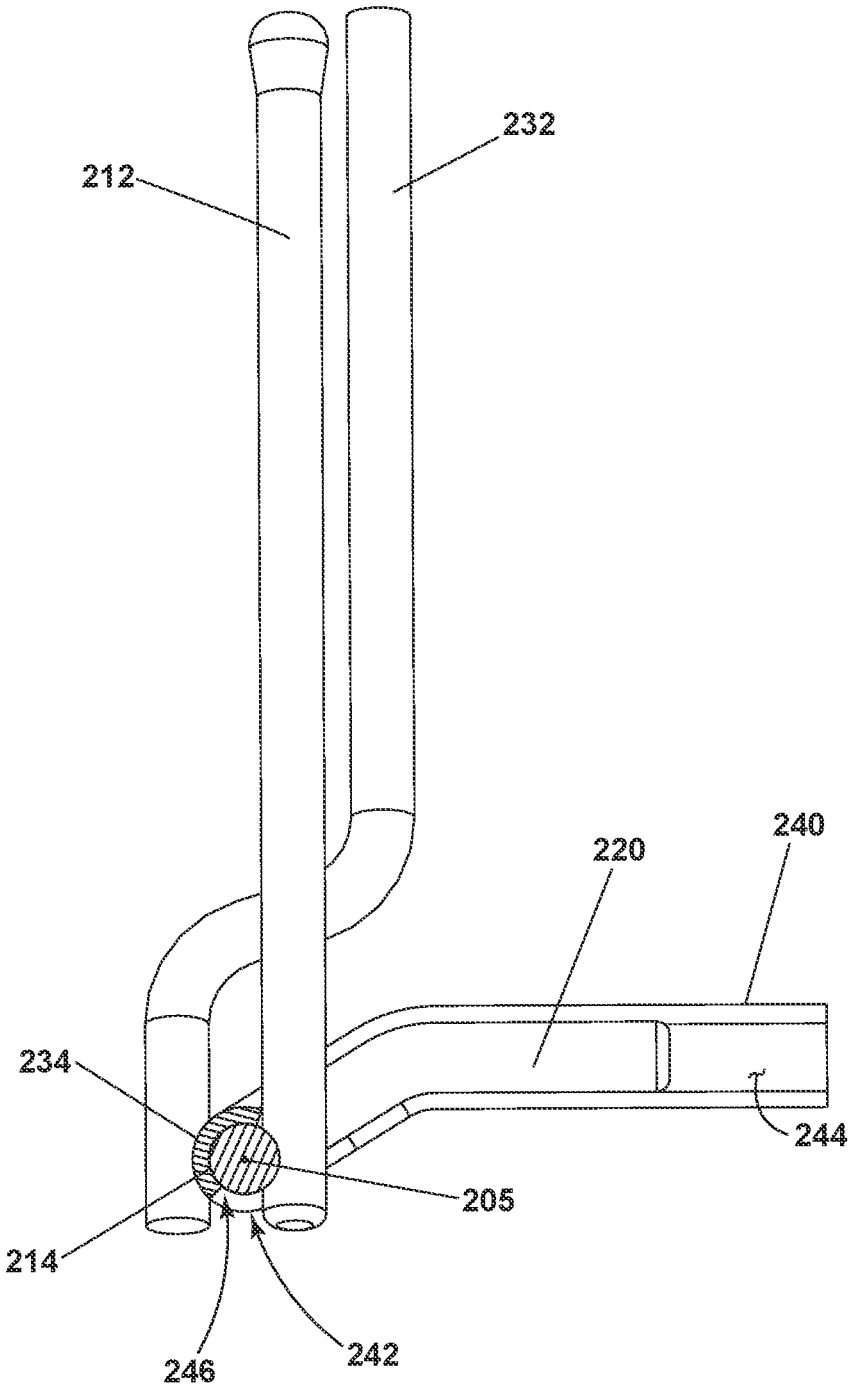
FIG. 7 illustrates a cross-sectional view of the first and second sets of tines of the adjustable tine assembly of FIG. 4.

Turning now to FIG. 7, the receiving of the first cross member 214 within the hollow interior 244 of the second cross member 234, and specifically that the portion of the second cross member 234 having the C-shaped cross section 242 only partially surrounds the circumference of the first cross member 214, can be better seen in the cross-sectional view of the first and second sets of tines 210, 230. More specifically, and by way of non-limiting example, the portion of the second cross member 234 having the C-shaped cross section 242 can surround at least half of the circumference of the first cross member 214. Further, at the point where the notch 246 is located, it is illustrated that the portion of the second cross member 234 defining the notch 246 surrounds less of the circumference of the first cross member 214 than the portion of the second cross member 234 having the C-shaped cross section 242 does. Further yet, and by way of non-limiting example, it is contemplated that, while the portion of the second cross member 234 having the C-shaped cross section 242 surrounds at least half of the circumference of the first cross member 214, the portion of the second cross member 234 defining the notch 246 can surround less than half of the circumference of the first cross member 214.

Figure 8:
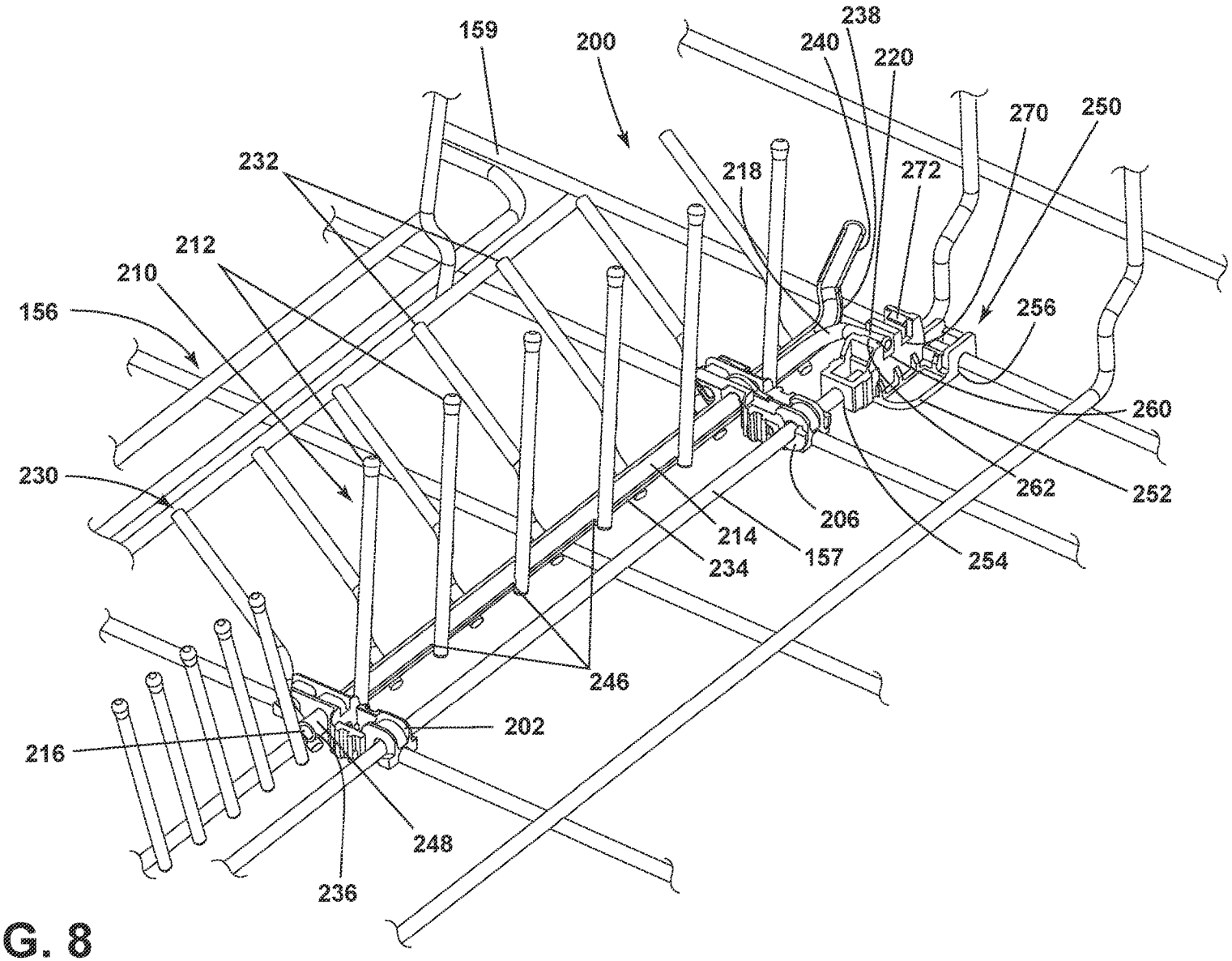
FIG. 8 illustrates an enlarged perspective view of the adjustable tine assembly of FIG. 4 including the first and second sets of tines, with the first set of tines in the upright rotational position and the second set of tines in a non-upright rotational position.

Turning now to FIG. 8, the adjustable tine assembly 200 is shown with the first set of tines 210 remaining in the upright rotational position as previously illustrated, and with the finger 220 selectively retained within the first detent 260 to selectively fix the first set of tines 210 in the upright rotational position, while the second set of tines 230 is rotated to a non-upright rotational position. In the non-upright rotational position as shown, the second cross member 234 is rotated about the first cross member 214 and about the common rotational axis 205 to tilt the second tines 232 toward the floor latticework 156, causing the notches 246 to be rotated upwardly about a portion of the first tines 212. In addition, the finger 240 is removed from engagement with and is rotated away from the strike 252 such that the finger 240 is no longer received within the second detent 270.

Figure 9:
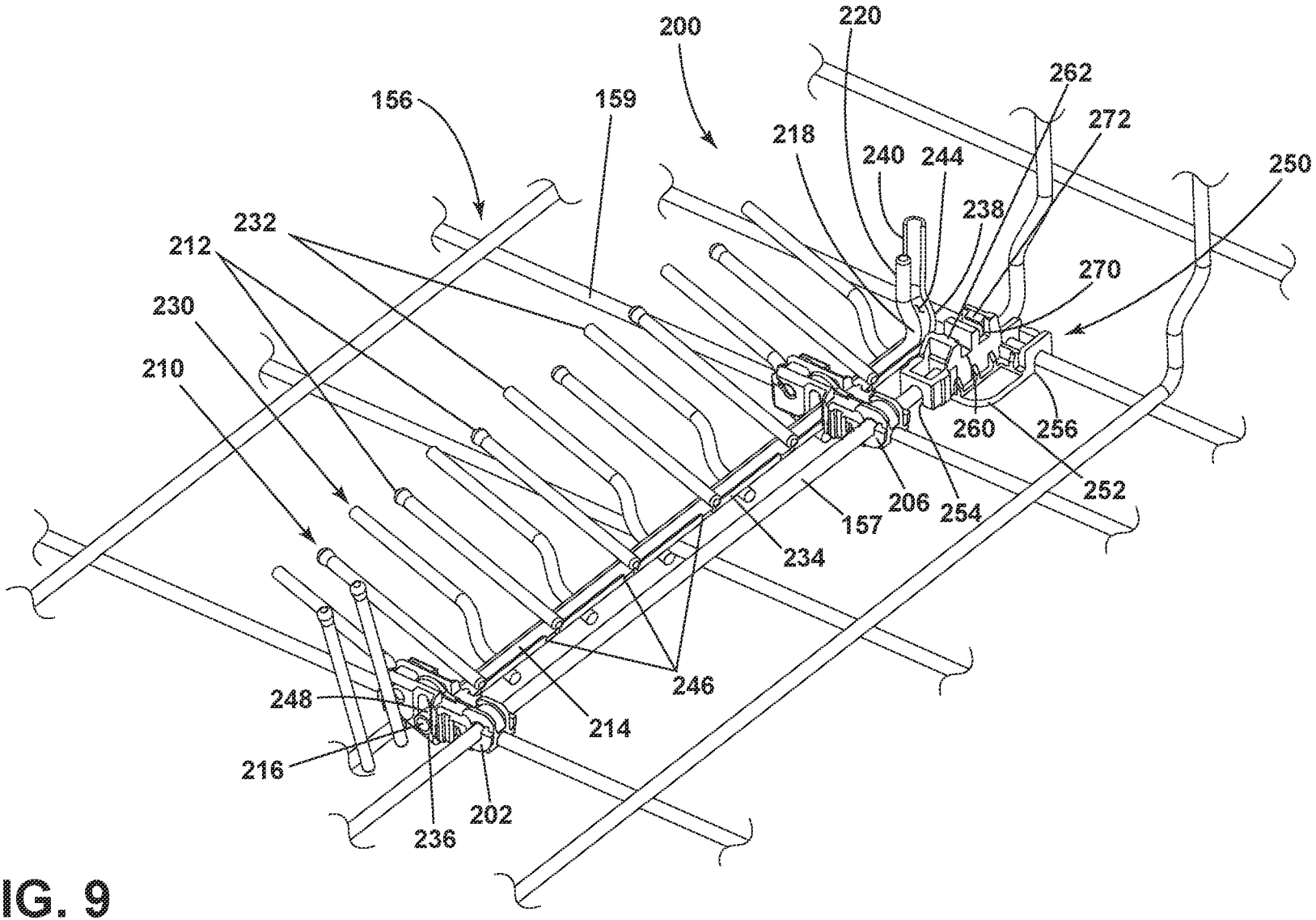
FIG. 9 illustrates an enlarged perspective view of the adjustable tine assembly of FIG. 4 including the first and second sets of tines, with both the first and second sets of tines in the non-upright rotational position.

Turning now to FIG. 9, the adjustable tine assembly 200 is shown with the second set of tines 230 remaining in the non-upright rotational position as illustrated in FIG. 8, and with the finger 240 removed from within the second detent 270 such that the rotational position of the second set of tines 230 is not fixed, while the first set of tines 210 is also rotated to the non-upright rotational position. In the non-upright rotational position of the first set of tines 210 as shown, the first cross member 214 is rotated within the second cross member 234 and about the common rotational axis 205 to tilt the first tines 212 toward the floor latticework 156, causing the first tines 212 to be rotated upwardly and at least partially out of receipt within the notches 246. In addition, the finger 220 is removed from engagement with and is rotated away from the strike 252 such that the finger 220 is no longer received within the first detent 260.

As presently illustrated, the second cross member 234 is provided with the notches 246 along only a lower portion of the C-shaped cross section 242 of the second cross member 234, which would prevent the first set of tines 210 from being movable to the non-upright rotational position while the second set of tines 230 was in the upright rotational position. However, it will be understood that this is not limiting, and that the second cross member 234 can additionally, or alternatively, include the notches 246 along an upper portion of the C-shaped cross section 242 of the second cross member 234 to allow the first set of tines 210 to be movable to the non-upright rotational position while the second set of tines 230 is in the upright rotational position.

Turning now to the operation of the adjustable tine assembly 200, either or both of the first and second sets of tines 210, 230 can be moved between at least the upright rotational position and at least one non-upright rotational position by a user grasping any one of the first and second tines 212, 232 and applying force to rotate the first or second set of tines 210, 230 in the desired direction. When rotating the first or second set of tines 210, 230 from the non-upright rotational position into the upright rotational position, the first or second set of tines 210, 230 is rotated to move the finger 220, 240 toward the strike 252 until the finger 220, 240 has snapped past the retaining flange 262, 272 and into the first or second detent 260, 270. When rotating the first or second set of tines 210, 230 from the upright rotational position into the non-upright rotational position, the first or second set of tines 210, 230 is rotated to move the finger 220, 240 away from the strike 252 until the finger 220, 240 has snapped past the retaining flange 262, 272 to be removed from the first or second detent 260, 270.

The aspects of the present disclosure described herein set forth an adjustable tine assembly for the angular or rotational position of tines or a row of tines to allow selective repositioning of the tines between at least a first and second rotational position in a user-friendly and simple manner, while maintaining stability of the tines, especially in an upright rotational position. The adjustable tine assembly ensures that the tines do not need to be bent to be repositioned, reducing likelihood of stressing the tines and also reducing the force needed to reposition the tines. The tines are also held firmly in the upright rotational position without the opportunity for the tines being left loose and unable to support dish items due to instability. The aspects of the present disclosure described herein also require few additional parts and are low cost and easy for a user to understand and manipulate, including that the adjustable tine row allows for one handed adjustability by a user. By providing the first and second adjustable sets of tines in coaxial arrangement, the adjustable tine assembly takes up less room along the bottom wall of the dish rack than by having two sets of adjustable tines with separate, side-by-side cross members that may interfere with one another when both sets of adjustable tines are moved to a non-upright rotational position. The coaxially arranged sets of tines can also be coupled to the dish rack using fewer clips and a shared latch assembly, rather than needing separate latch assemblies.

It will also be understood that various changes and/or modifications can be made without departing from the spirit of the present disclosure. By way of non-limiting example, although the present disclosure is described for use with a wire dish rack, it will be recognized that the adjustable tine assembly can be employed with various rack constructions, including molded racks, such as racks molded of plastic.

To the extent not already described, the different features and structures of the various aspects can be used in combination with each other as desired. That one feature is not illustrated in all of the aspects is not meant to be construed that it cannot be, but is done for brevity of description. Thus, the various features of the different aspects can be mixed and matched as desired to form new aspects, whether or not the new aspects are expressly described. Combinations or permutations of features described herein are covered by this disclosure.

This written description uses examples to disclose aspects of the disclosure, including the best mode, and also to enable any person skilled in the art to practice aspects of the disclosure, including making and using any devices or systems and performing any incorporated methods. While aspects of the disclosure have been specifically described in connection with certain specific details thereof, it is to be understood that this is by way of illustration and not of limitation. Reasonable variation and modification are possible within the scope of the forgoing disclosure and drawings without departing from the spirit of the disclosure, which is defined in the appended claims.

What is claimed is:

1. A dish rack assembly comprising:

a dish rack defining an interior; and an adjustable tine assembly located within the interior and comprising first and second sets of tines, which are coaxial about a common rotational axis, and rotatable about the rotational axis, the first set of tines having a first cross member from which multiple first tines extend, and the second set of tines having a second cross member from which multiple second tines extend, the second cross member having a length and a C-shaped cross section along a majority of the length, the C-shaped cross section defining a hollow interior, which receives the first cross member.

2. The dish rack assembly of claim 1 wherein the second cross member is resilient and the C-shaped cross section snaps over the first cross member.

3. The dish rack assembly of claim 1 wherein the length of the second cross member is co-extensive in length with the first cross member.

4. The dish rack assembly of claim 1 wherein the length of the second cross member is greater than the length of the first cross member.

5. The dish rack assembly of claim 1 wherein the C-shaped cross section of the second cross member surrounds at least half of the circumference of the first cross member.

6. The dish rack assembly of claim 1 wherein the C-shaped cross section of the second cross member surrounds at least half of the circumference of the first cross member along at least half of the total length of the first cross member.

7. The dish rack assembly of claim 6 wherein at least a portion of the second cross member completely surrounds the circumference of at least a portion of the first cross member.

8. The dish rack assembly of claim 7 wherein the at least a portion of the second cross member that completely surrounds the circumference of the first cross member is at a distal end of the second cross member.

9. The dish rack assembly of claim 1 wherein the first cross member comprises a solid rod.

10. The dish rack assembly of claim 1 wherein the first and second cross members are rotatable relative to one another about the common rotational axis.

11. The dish rack assembly of claim 1 wherein the C-shaped cross section of the second cross member includes a plurality of notches spaced apart along the length of the second cross member.

12. The dish rack assembly of claim 11 wherein the plurality of notches correspond to the positions of the multiple first tines of the first set of tines.

13. The dish rack assembly of claim 1 wherein the adjustable tine assembly further comprises a latch assembly selectively fixing a rotational position of at least one of the first and second sets of tines.

14. The dish rack assembly of claim 13 wherein the latch assembly selectively fixes a rotational position of both of the first and second sets of tines, independently of one another.

15. The dish rack assembly of claim 14 wherein the latch assembly comprises a strike and each of the first and second sets of tines comprises a latch that selectively engages with the strike to fix the rotational position of each of the first and second sets of tines.

16. The dish rack assembly of claim 15 wherein the latch of each of the first and second sets of tines comprises a finger extending radially outwardly from the rotational axis of each of the first and second cross members.

17. The dish rack assembly of claim 16 wherein the strike comprises a body configured to mount on at least a portion of the dish rack and defining first and second detents, wherein one of the first and second detents is configured to selectively receive the finger of the first cross member, while the other of the first and second detents is configured to selectively receive the finger of the second cross member.

18. The dish rack assembly of claim 17 wherein the fingers of the first and second cross members form a snap fit attachment within the first and second detents.

19. The dish rack assembly of claim 17 wherein each of the first and second sets of tines are fixed in an upright rotational position when the fingers of the first and second cross members are received within the first and second detents.

20. An adjustable tine assembly for use within an interior of a dish rack of a dish treating appliance, the adjustable tine assembly located within the interior and comprising:

first and second sets of tines, which are coaxial about a common rotational axis, and rotatable about the rotational axis, the first set of tines having a first cross member from which multiple first tines extend, and the second set of tines having a second cross member from which multiple second tines extend, the second cross member having a length and a C-shaped cross section along a majority of the length, the C-shaped cross section defining a hallow interior, which receives the first cross member.

* * * * *